US005191847A

United States Patent [19]

Kojima et al.

[11] Patent Number: 5,191,847

[45] Date of Patent: Mar. 9, 1993

[54] TENSION REGULATING DEVICE

[75] Inventors: Shinji Kojima; Makota Kamewada, both of Tochigi, Japan

[73] Assignee: The Singer Company N.V., Edison, N.J.

[21] Appl. No.: 844,095

[22] Filed: Mar. 2, 1992

[30] Foreign Application Priority Data

Apr. 16, 1991 [JP] Japan ..... 3-33842

[51] Int. Cl.[5] ..... D05B 47/02; B65H 59/22

[52] U.S. Cl. ..... 112/254; 242/150 R

[58] Field of Search ..... 112/254, 302; 242/148, 242/149, 150 R, 155 R

[56] References Cited

U.S. PATENT DOCUMENTS

| | | | |
|---|---|---|---|
| 267,563 | 11/1882 | Mitchell | 112/254 X |
| 1,820,119 | 8/1931 | Chason | 112/254 X |
| 2,131,005 | 9/1938 | Chason | 242/150 |
| 2,518,703 | 8/1950 | Marsac | 112/254 X |
| 2,937,605 | 5/1960 | Dunn et al. | 112/254 |
| 2,955,775 | 10/1960 | Johnson | 112/254 X |
| 2,993,456 | 7/1961 | Heebst | 112/254 |
| 3,366,083 | 1/1968 | Ketterer et al. | 242/150 X |

*Primary Examiner*—Clifford D. Crowder

*Assistant Examiner*—Paul C. Lewis

*Attorney, Agent, or Firm*—Theodore Jay

[57] ABSTRACT

A tension regulating device can set an indicating value of a thread tension. The tension regulating device comprises a regulating nut which is screwed into the male portion of a tension regulating shaft for compressing the tension regulating spring and a regulating dial having scales. The regulating dial is rotatable to turn the regulating nut to set the tension of a thread, which is held by the tension discs in response to the turning position of the regulating nut. The tension regulating device further comprises a regulating dial stop retained by a step portion of the tension regulating shaft and a short cylindrical member fixedly engaged in the cylindrical portion of the tension regulating shaft for clamping the regulating dial stop. The short cylindrical member has spline grooves defined at the outer periphery thereof. A cap has an indicating needle corresponding to one of the scales of the regulating dial, the cap having an outward directed flange portion defined at one end thereof for engaging in the spline grooves of the short cylindrical member whereby the regulating dial is rotatably clamped between the outward directed flange portion of the cap and the regulating dial stop.

2 Claims, 3 Drawing Sheets

TENSION REGULATING DEVICE

BACKGROUND OF THE INVENTION

1. Field of the Invention

The present invention relates to a tension regulating device of a sewing machine.

2. Prior Art conventionally known is a tension regulating device comprising a regulating dial having a dial and a cap having an arrow corresponding to the dial wherein the regulating dial and the cap are provided at the same unit. It was difficult to conform the arrow of the cap to the scale of the regulating dial which sets a reference thread tension and mounts the cap on the regulating dial. Furthermore, this device has the disadvantage that the reference thread tension can not be changed easily.

In the tension regulating device as illustrated in FIGS. 4 and 5, a supporting plate 103 having an arrow 102 is attached by an adhesive or the like to a plate supporter 104 which is mounted on the tip end of the tension regulating shaft 101. In this tension regulating device, the reference thread tension is set separately for each unit. That is, a regulating nut, which is to be screwed into the tension regulating shaft 101 is rotated in one direction or the other to compress or release a tension regulating spring 108 and set the reference thread clamping pressure applied between a pair of tension discs 106 and 107. A regulating dial 110 is inserted into the tension regulating shaft 101 in predetermined relation while a projection 110*a* thereof is meshed with one of the notches 105*a* of the outer periphery of the regulating nut 105. The supporting plate supporter 104 is screwed into the tip end of the tension regulating shaft 101 by way of a Belleville spring 111. Thereafter, the scale appearing in the regulating dial 110 is appropriately conformed to the arrow 102 of the supporting plate 103. In such a manner, after the reference thread tension is set per each unit, the base end of the tension regulating shaft 101 is screwed into a frame 109 and attached thereto.

An operation to connect positional deviation between the scale 110*b* of the regulating dial 110 and the arrow 102, which is carried out before a practical sewing operation, involves an operation to remove the supporting plate 103 from the supporting plate supporter 104 and an operation to attach the supporting plate 103 to the supporting plate supporter 104, which renders the arrow 102 unclear and also renders the supporting plate 103 difficult to be attached to the correct position. The operation to reset the reference thread tension, which was set as set forth above, is troublesome when changing the mesh of the projection 110*a* with one of the notches 105*a* of the regulating nut 105 since not only the regulating dial but also the supporting plate 103, the supporting plate supporter 104, which is screwed into the tension regulating shaft 101, and the Belleville spring 111 must be removed.

SUMMARY OF THE INVENTION

The present invention WAS TO OVERCOME the problems of the conventional tension regulating device and is directed toward a tension regulating device which comprises a tension regulation shaft having a base end fixed to a frame of a sewing machine, a shaft portion and a male screw portion; a pair of tension discs; a tension regulating spring for applying thread clamping force to the pair of tension discs. The pair of tension discs and the tension regulating spring are engaged in the shaft portion of the tension regulating shaft. A regulating nut is screwed into the male screw portion of the tension regulating shaft for compressing the tension regulating spring. A regulating dial has scales, the regulating dial being turned to turn the regulating nut for setting the tension of the thread. The thread is clamped by the tension discs in response to the turning position of the regulating nut. The tension regulating device further comprises a regulating dial stop retained by a step portion of the tension regulating shaft; a short cylindrical member fixedly engaged in the cylindrical portion of the tension regulating shaft for clamping the regulating dial stop, the short cylindrical member having spline grooves defined at the outer periphery thereof, and a cap having an indicating needle corresponding to one of the scales of the regulating dial. The cap has an outward directed portion defined at one end thereof and convex portions defined at inner peripheral surface for engaging in the spline grooves of the short cylindrical member whereby the regulating dial is rotatably clamped between the outward directed flange portion of the cap and the regulating dial stop.

PREFERRED EMBODIMENT OF THE INVENTION

Figure 1:
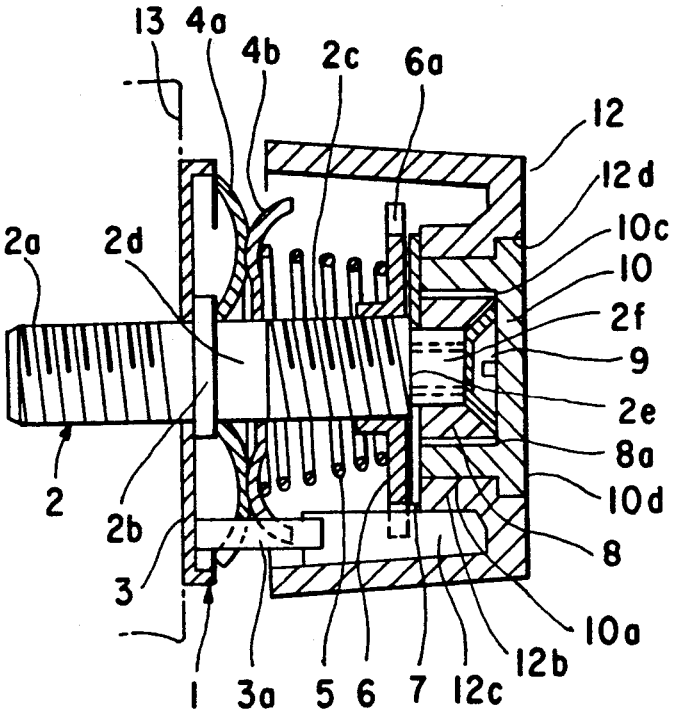
FIG. 1 is a cross-sectional view of a tension regulating device according to a preferred embodiment of the present invention.
Figure 2:
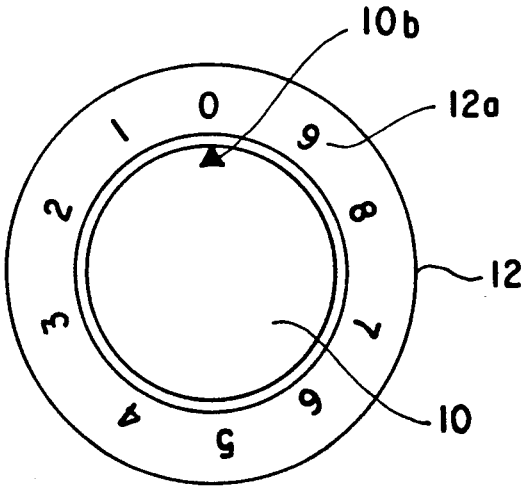
FIG. 2 is a front view of the tension regulating device of FIG. 1.
Figure 3:
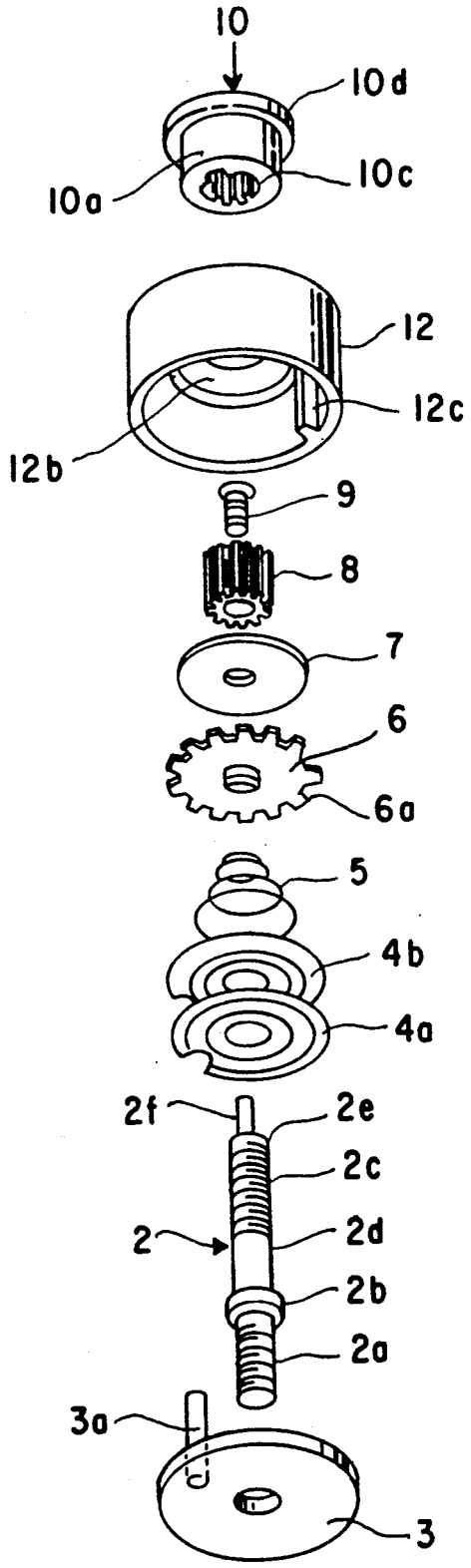
FIG. 3 is an exploded perspective view of the tension regulating device of FIG. 1.
Figure 4:
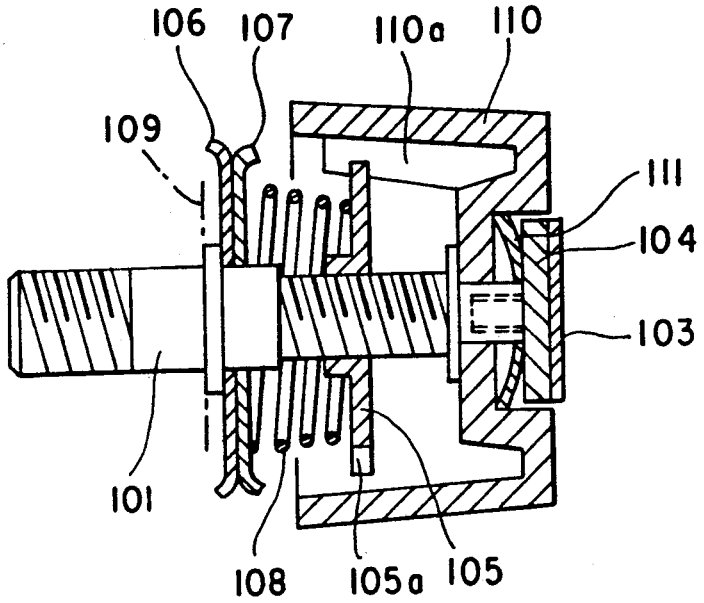
FIG. 4 is a cross-sectional view of a known tension regulating device.
Figure 5:
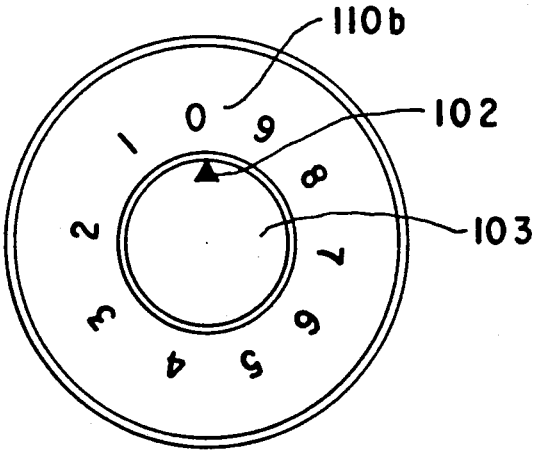
FIG. 5 is a front view of the known tension regulating device in FIG. 4.

A tension regulating device according to a preferred embodiment of the present invention is shown in FIGS. 1 to 3.

The tension regulating device includes a tension regulating shaft 2 fixed to a frame 13 of a sewing machine. A pair of tension discs 4*a*, 4*b* are screwed into region 2*d* of the tension regulating shaft. A tension regulating spring 5 is screwed into the tension regulating shaft region 2*c* and bears against tension disc 4*b*. The tension regulating shaft comprises a screwed rod portion 2*a*, a collar portion 2*b* as well as shaft portion 2*d*. The shaft portion 2*d* is composed of a male screw portion 2*c* and a front hollow cylindrical portion 2*f* which is secured to the shaft portion 2*d* by an annular step portion or shoulder 2*e*. Portion 2*f* has a female screw portion at the inner periphery thereof. The outer diameter of the cylindrical portion 2*f* is smaller than that of the shaft portion 2*d*. The screwed rod portion 2*a* is screwed into the frame 13 of sewing machine. A tension regulating dial rotation limit plate 3 is clamped in position by the collar portion 2*b* and is secured to the frame 13. The tension discs 4*a* and 4*b* contact each other and a regulating nut 6 is screwed into the male screw portion 2*c* of the tension regulating shaft 2 to thereby compress a tension regulating spring 5 against disc 4*b*.

Engaged into the outer periphery of cylindrical portion 2*f* of the tension regulating shaft 2 is an annular regulating dial stop 7, which bears against the step portion 2e, and a short cylindrical member 8, which has spline grooves 8a at the outer periphery thereof in the direction of the central axial line. The short cylindrical member 8 is secured to the cylindrical portion 2f by a set screw 9 to thereby clamp the regulating dial stop 7 between the short cylindrical member 8 and the step portion 2e.

A cylindrical cap 10, which has a closed bottom, covers the short cylindrical member 8. The cap 10 has an indicating needle, i.e. an arrow 10b, which is indicated at the tip end surface thereof, and a plurality of convex portions 10c defined in an inner periphery thereof which are formed in a given interval in the circumferential direction thereof. Each of the convex portions 10c is frictionally retained by each of the corresponding spline grooves 8a of the short cylindrical member 8. A regulating dial 12 has scales 12a on the same circumferential surface thereof and a boss portion 12b. The boss portion 12b is rotatably engaged with the outer peripheral cylindrical surface 10a of the cap and is closely fitted between the regulating dial stop 7 and an outward directed flange portion 10d of the cap 10.

The outward directed flange portion 10d of the cap 10 is received by an annular recessed portion 12d, which is defined at the tip end inner peripheral edge of the boss portion 12b so that an indicating surface of the scales 12a of the regulating dial 12 is flush with an indicating surface of the arrow 10b.

The regulating dial 12 has one projection 12c which is defined inside thereof and extends in the direction of the central axial line thereof. The projection 12c is retained by one of the notches 6a defined at the outer periphery of the regulating nut 6. When the regulating dial 12 is rotated in either direction, the regulating nut 6 can be rotatably driven in like direction. When the regulating nut 6 is tunably driven, it moves along the male screw portion 2c in the direction of the central axial line of the tension regulating shaft 2 so that the compression force of the tension regulating spring 5 and tension of the thread which is caught between the pair of tension discs 4a and 4b can be adjusted to be strong or weak. A base end of the projection 12c of the regulating dial 12 can be retained by a restriction pin 3a which protrudes from the outer peripheral portion of the regulating dial rotation limit plate 3 in the central axial line thereof. In such a case, a turning motion of the regulating dial 12 is restricted by one revolution. The restriction pin 3a is received by the recessed portions of the pair of tension discs 4a and 4b.

An operation of tension regulating device will be described hereinafter.

Described first is an operation to set a reference tension and operation to correctly conform the arrow 10b of the cap 10 to one of the scales 12a of the regulating dial 12. The regulating dial 12 is pulled out from the short cylindrical member 8 to take out the cap 10 which is integrated with the outward directed flange portion 10d. Then, the regulating nut 6 is turned to thereby set a reference thread clamping pressure between the pair of tension discs 4a and 4b. At this state, the arrow 10b, of the cap 10 is set to one of the scales 12a of the regulating dial 12 and then the convex portion 10c of the cap 10 is pressed into the spline grooves 8a of the short cylindrical member 8. The attachment of the regulating dial 12 is carried out by inserting the projection 12c of the regulating dial 12 into one of the notches 6a of the regulating nut 6 taking into consideration the restriction pin 3a of the tension regulating dial rotation limit plate 3.

An operation to correct positional deviation between one of scales 12a of the regulating dial 12 and the arrow 10 is carried out in the same manner as set forth above before the sewing operation is carried out.

Furthermore, an operation to correct the thus set reference thread tension is carried out in the same way as the operation to set the reference tension. That is, the positioning operation to conform to the arrow 10b of the cap 10 to one of the scales 12a of the regulating dial 12 is carried out by pulling the regulating dial 12 together with the cap 10 out of the short cylindrical member 8 and thereafter pushing them in the short cylindrical member 8.

Since the spline grooves 8a are used for engaging the short cylindrical member 8, which is to be fixed to the tension regulating shaft 2, with the cap 10, if the notches of the spline grooves 8a are defined in such a manner that each interval of the crests of the notches is smaller, the arrow 10b of the cap can be minutely adjusted with respect to the short cylindrical member 8 in the circumferential direction thereof, whereby the circumferential fixing position of the short cylindrical member 8 to the tension regulating shaft 2 can be arbitrarily determined. Since the plurality of convex portions 10c of the cap 10 are fictionally retained by the notches of the spline grooves 8a, the cap 10 is not dropped from the short cylinder member 8 even if the cap is detachably operated several times.

Furthermore, the number of turnings of the regulating dial 12 is limited within one revolution, so that the compression force of the tension regulating spring 5 is not liable to be over or under adjusted.

In the arrangement set forth above, although the short cylindrical member 8 has splines 8a and the cap 10 has the convex portions 10c, the short cylindrical member 8 may have convex portions and the cap 10 may have spline grooves. In the latter case, the same effect as that of the former can be obtained.

The following advantages can be obtained according to the present invention.

In the assembling of the sewing machine or before the sewing operation starts, it is possible to easily and accurately set the reference thread tension to precisely conform the position of the indicating needle of the cap to one of the scales of the regulating dial to correct such position and to minutely adjust the thread tension based on the relative position between the indicating needle of the cap and one of the scales of the regulating dial. Furthermore, it is also possible to carry out positioning of the indicating needle to conform to one of the scales with ease and accuracy when the cloth to be sewn is changed from the thin cloth to the thick cloth or the thread is changed from the small yarn number to the large yarn number.

According to a second aspect of the invention, since the number of rotations of the regulating dial is limited to such an extent that the projection of the regulating dial is retained by the restriction pin of the tension regulating dial rotation limit plate, namely, within one revolution of the regulating dial, the compression force of the tension regulating spring, i.e. the thread clamping force by the pair of tension discs, will not be too large or small.

What is claimed is:

1. A tension regulating device adapted to be secured to the frame of a sewing machine and comprising:

a tension regulating shaft having a screwed rod portion extending from one end, a shaft portion extending from the other end and a collar portion disposed between the rod portion and the shaft portion, the shaft portion having a male screw section terminating in a reduced shoulder and a front hollow cylindrical section extending from the shoulder, the rod portion being secured to the frame;

a collar secured to the collar portion;

first and second tension discs, the first disc being disposed on the collar portion and engaging the collar, the second disc being disposed on the collar portion and engaging the one side of the collar, the discs being adapted to receive a sewing machine thread therebetween;

a compression spring disposed on the male screw portion with one end of the spring bearing against the second disc;

a regulating nut engaging the male screw portion and bearing against the other end of the spring to adjust the compression of the spring;

a regulating dial stop disposed on the male screw portion and bearing against the shoulder of the regulating shaft;

a regulating dial having scales, the dial being disposed on the male screw portion and bearing against the dial stop, said dial engaging the nut so that rotation of the dial rotates the nut;

a short cylindrical member secured in the front hollow cylindrical section of the regulating shaft for clamping the dial stop, the member having spline grooves at the outer periphery thereof; and a cap having an indicating needle corresponding to one of the scales of the dial and engaging the spline grooves of the member to rotatably clamp the dial between the cap and the dial stop.

2. The device of claim 1, further including a regulating dial rotation limit plate secured to the collar portion of the shaft and engaging the other side of the collar, the limit plate having a projecting pin engageable with a projection on the dial to limit the rotation thereof.

* * * * *